United States Patent [19]

Scala

[11] Patent Number: 4,457,397

[45] Date of Patent: Jul. 3, 1984

[54] PLATFORM FOR STAIRS

[76] Inventor: John J. Scala, 1968 Somerset, Wheaton, Ill. 60187

[21] Appl. No.: 320,054

[22] Filed: Nov. 10, 1981

[51] Int. Cl.[3] ..... E04G 1/36; E06C 7/44

[52] U.S. Cl. ..... 182/116; 182/179; 182/184; 182/200

[58] Field of Search ..... 182/107, 108, 179, 115, 182/116, 200, 184

[56] References Cited

U.S. PATENT DOCUMENTS

| | | | |
|---|---|---|---|
| 1,057,722 | 4/1913 | Goetz | 182/179 |
| 1,325,423 | 12/1919 | Stuart | 182/116 |
| 1,474,250 | 11/1923 | Folliard | 182/116 |
| 2,044,703 | 6/1936 | Kline | 182/179 |
| 2,556,611 | 6/1951 | Borgman | 182/179 |
| 3,554,318 | 1/1971 | Knight | 182/24 |

FOREIGN PATENT DOCUMENTS

| | | | |
|---|---|---|---|
| 81751 | 1/1919 | Switzerland | 182/204 |
| 1048823 | 11/1966 | United Kingdom | 182/116 |

*Primary Examiner*—R. P. Machado

[57] ABSTRACT

This invention relates to new and useful improvements in a platform for stairs, and the principal object of the invention is to provide a device which may be effectively employed as a scaffold structure for stairs, or a step-up platform to reach portions of the ceiling and the walls of a room.

1 Claim, 7 Drawing Figures

FIG. 6.
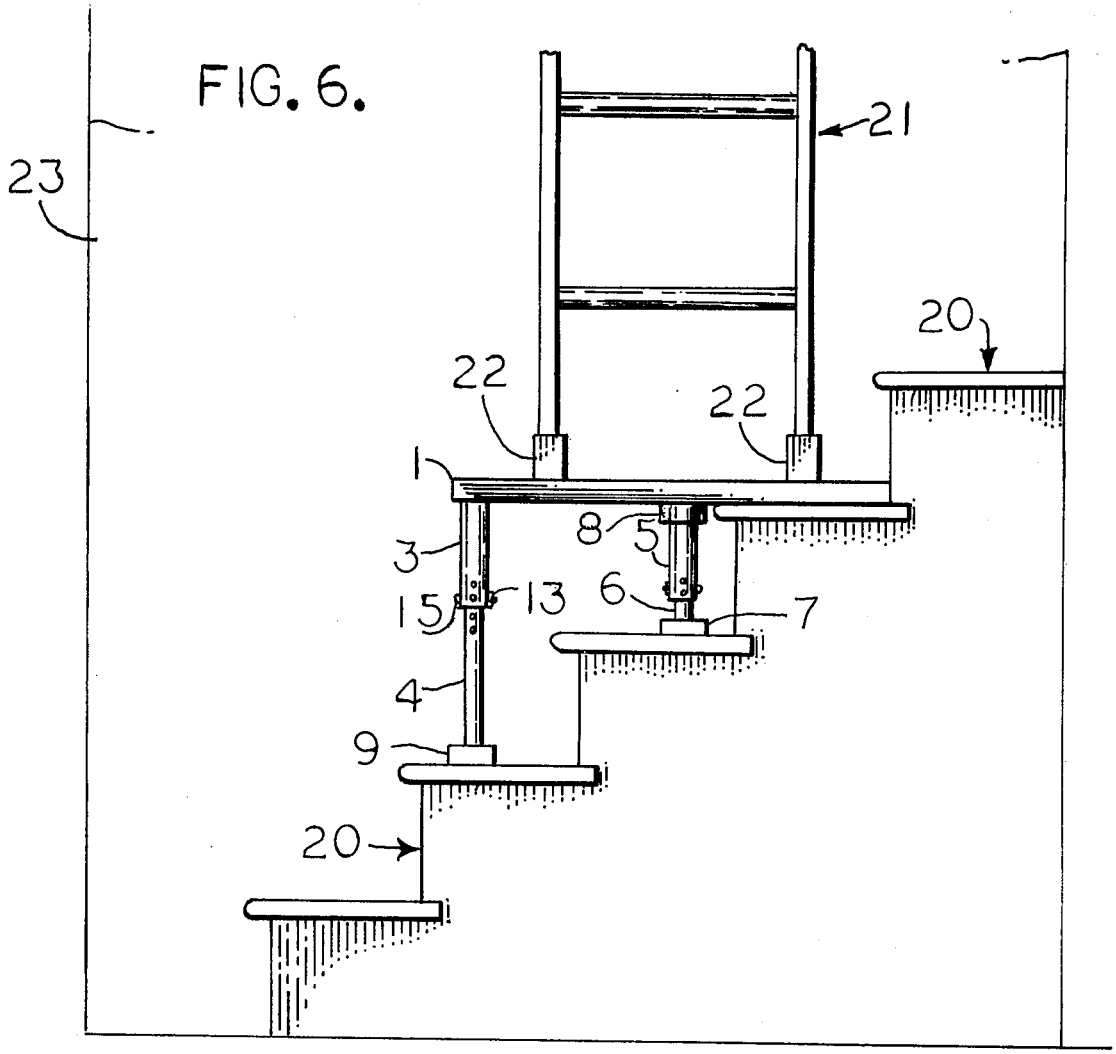
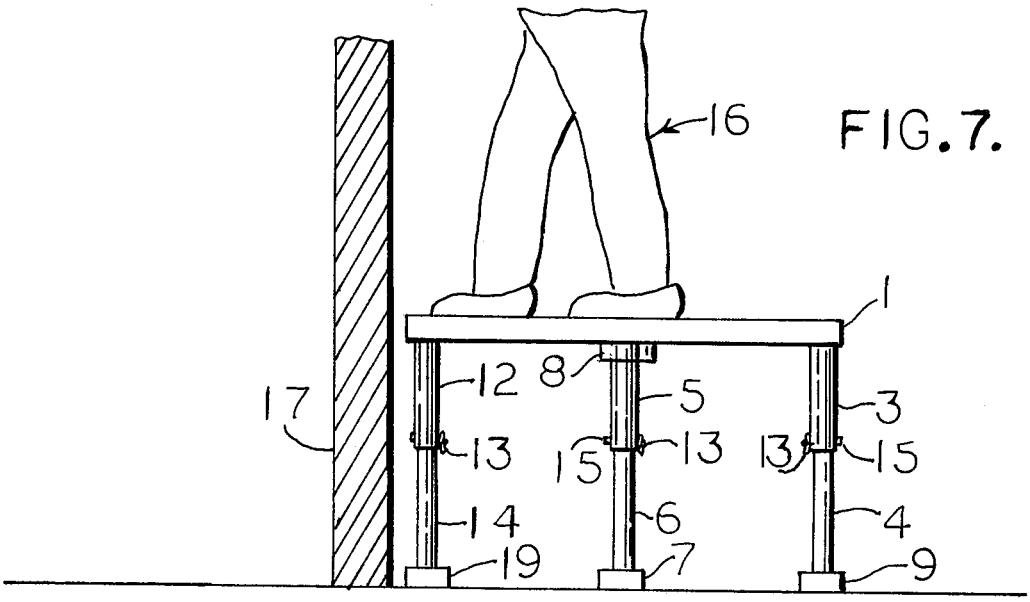
FIG. 7.

PLATFORM FOR STAIRS

BACKGROUND OF THE INVENTION

This invention relates to new and useful improvements in a platform for stairs, and the principal object of the invention is to provide a device which may be effectively employed as a scaffold structure for stairs, or a step-up platform to reach portions of the ceiling and the walls of a room.

In the past it has been necessary to use a complicated scaffold structure on stairs. Scaffolds are quite expensive to purchase or lease, and require considerable time to erect. Often a number of separate sections of scaffolds have to be secured together in the desired configuration.

SUMMARY OF THE INVENTION

According to the present invention, there is provided a platform for stairs which comprises a plurality of legs supporting a first end of the platform, and a second plurality of legs supporting a middle portion of the platform. An end of the platform opposite the first end is supported by either resting directly on a stair step or by a third plurality of legs. The platform has a frame around the perimeter that serves as a means to secure the legs to the platform, and to keep ladders and the like placed on the platform from sliding off the platform. The legs are adjustable to different vertical heights, and the legs are attached to the platform in such a manner as to allow the legs to rest on steps of varying widths without changing the spacing between the legs.

One of the objects of the invention is to provide a platform which is simple and inexpensive in construction, and which can be used with steps and the like, thereby dispensing with complicated and expensive scaffolding.

Another object of the invention is to provide a platform that accepts a variety of stair step widths without adjustment.

A further object of the invention is to provide a platform that adjusts to various step heights.

Still a further object of the invention is to provide a level platform to replace a step ladder in normal house decorating.

Other and further objects and advantages of the invention will be hereinafter set forth and novel features thereof defined by the claims.

BRIEF DESCRIPTION OF THE DRAWINGS

FIG. 6 is a side view of the stairs platform illustrating the use of the invention on the stairs.

FIG. 7 is a side plan view of the platform illustrating the use of the invention as a step-up platform.

DESCRIPTION OF THE PREFERRED EMBODIMENT

Figure 1:
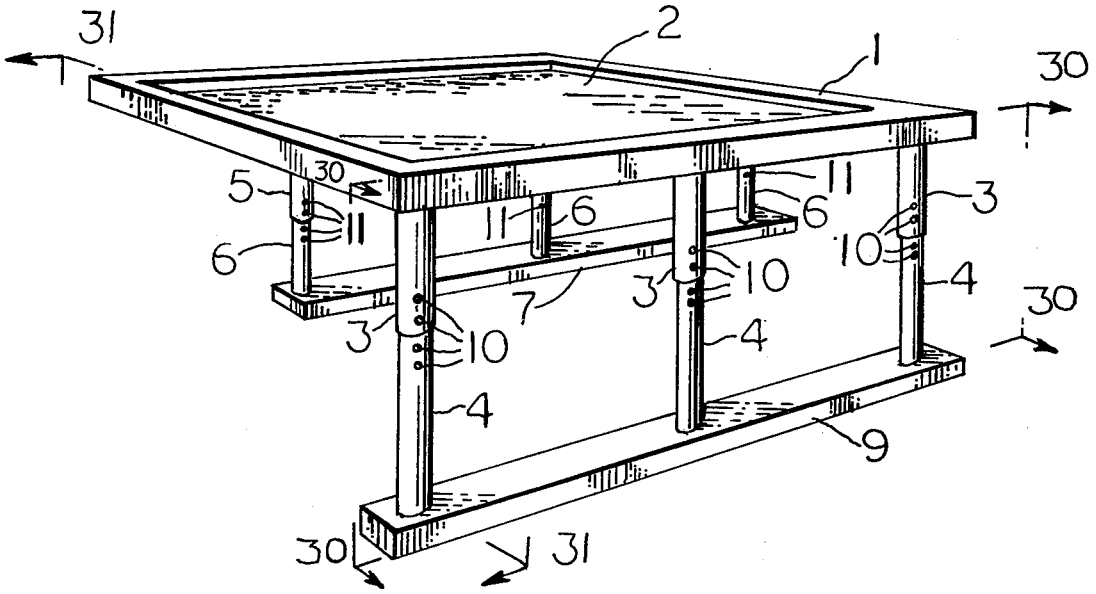
FIG. 1 is a perspective view of the invention.
Figure 2:
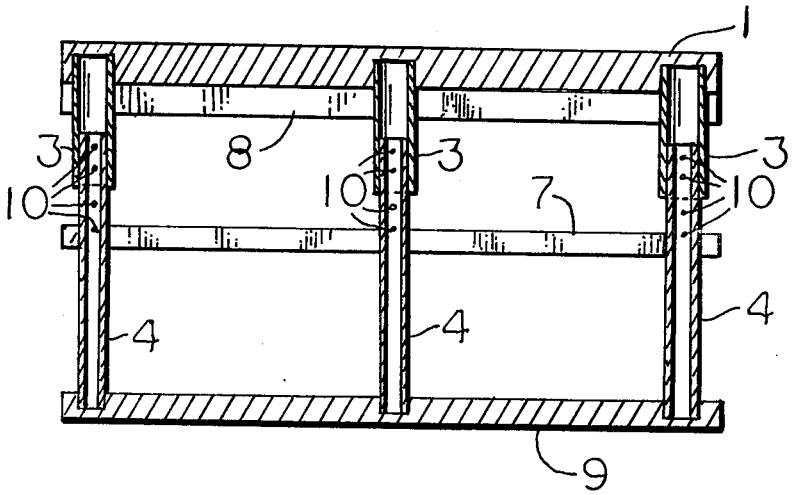
FIG. 2 is a cross-sectional view, taken substantially in the plane of the line 30—30 in FIG. 1.
Figure 5:
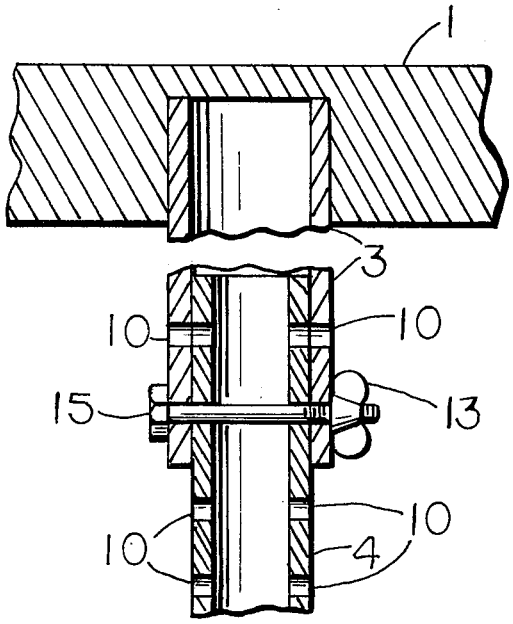
FIG. 5 is an enlarged fragmentary view of a leg, sleeve, and the frame shown in FIG. 2.

In FIG. 1. there is illustrated one embodiment of the present invention. A platform 2 is integrally secured to a frame 1. First sleeves 3 are attached to the frame 1 as best shown in FIG. 2., and extend transversely from the bottom portion of the frame 1. The first lower legs 4 slide inside the sleeves 3, and are rigidly secured to the sleeves 3 by means of bolts 15 and wing nuts 13 as shown in FIG. 5. A plurality of openings 10 are provided so that the legs 4 may be slid in or out of sleeves 3, and bolts 15 can be pushed through openings 10 in sleeves 3 and legs 4 that are in line, to secure the lower leg 4 to the sleeve 3. Thus the height of the platform 2 may be adjusted by selecting various openings 10 in sleeves 3 and legs 4. The end of the legs 4 opposite the end slid inside sleeve 3 is integrally secured to a bracing and supporting bar 9 as shown in FIG. 1. The supporting bar 9 is essentially parallel to the platform 2.

Figure 3:
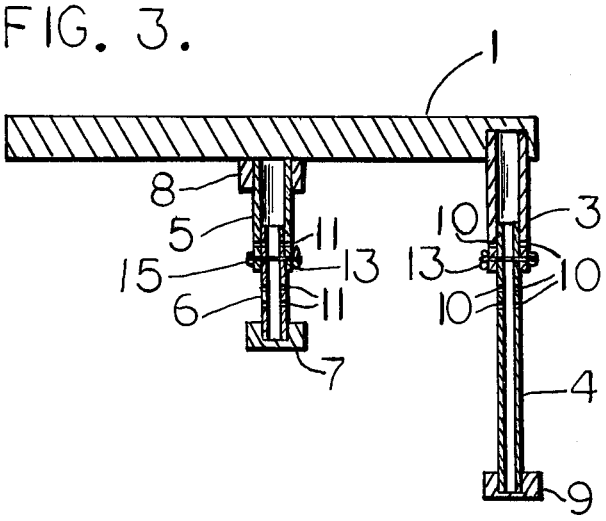
FIG. 3 is a cross-sectional view, taken substantially in the plane of the line 31—31 in FIG. 1.

As best shown in FIG. 3, a plurality of second sleeves 5 are attached to the middle bar 8, and extend transversely from the bottom portion of the middle bar 8. The middle bar 8 is integrally secured to the frame 1 and the platform 2. The second lower legs 6 slide inside the second sleeves 5, and are rigidly secured to the sleeves 5 by means of bolts 15 and wing nuts 13. A plurality of openings 11 are provided so that the second legs 6 may be slid in or out of sleeves 5, and the bolts 15 can be pushed through any number of openings 11 in sleeves 5 and legs 6 that are in line so that the lower legs 6 are secured rigidly to the sleeves 5. Thus the middle portion of the platform 2 can be supported by adjusting the second plurality of legs 6 to a different height or the same height as the first plurality of legs 4. The end of the legs 6, opposite the end slid inside sleeves 5 are integrally secured to a bracing and supporting bar 7 as shown in FIG. 1. The supporting bar 7 is essentially parallel to the platform 2. The bottom portion of the platform 2 opposite the first end of the platform 2, rests horizontally against a stair step of stairs 20 as shown in FIG. 6 when the invention is used for stairs 20.

When the invention is used as a step-up platform to reach portions of wall 17 as shown in FIG. 7, a third plurality of sleeves 12 and legs 14 can be attached to the frame 1 opposite the first end of the platform 2, and in an identical manner to the method used to attach the first plurality of sleeves 3 and legs 4. This method of attaching the sleeves 12 to the frame, and rigidly securing the third plurality of legs 14 by the bolts 15 and the wing nuts 13, is best shown in FIG. 5. The plurality of legs 14 are secured integrally to a third bracing and supporting bar 19. The third supporting bar 19 is essentially parallel to the platform 2. A person 16 may thus be supported by the platform 2 when all legs 14, 6, and 4 are adjusted to the same height, as shown in FIG. 7.

Figure 4:
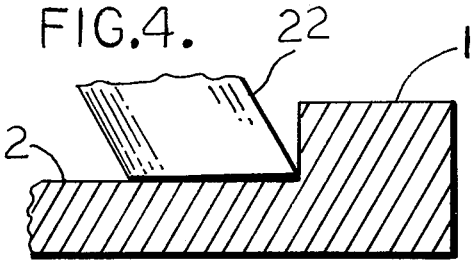
FIG. 4 is an enlarged fragmentary view of the platform and frame of the platform for stairs.

When the novel invention is in use, the platform for stairs is carried to the stairs 20, and the first and second plurality of legs 4 and 6 are adjusted so that the platform 2 is level with the stairs 20 as shown in FIG. 7. The plurality of legs 4 are slid inside sleeves 3, and secured rigidly in place by the bolts 15 and the wing nuts 13. The supporting bar 9 rests firmly against one step, while the lower portion of the platform 2 and frame 1 opposite the first plurality of sleeves 3 and legs 4, rests on a step two steps higher on the stairs 20. The second plurality of sleeves 5 and legs 6 may be adjusted next so that the second supporting bar 7 rests firmly against a step one step higher on the stairs 20 than the step against which the first supporting bar 9 rests. The plurality of legs 6 and sleeves 5 are secured rigidly in place by the bolts 15 and wing nuts 13. The platform 2 is than ready for use and can be moved up and down the stairs 20 to provide a platform 2 at various levels on the stairs 20. A ladder 21 may then be placed on the platform 2 with the feet of the ladder 22 resting against the frame 1. The frame 1 keeps the ladder 21 from sliding off the platform 2 as shown in FIG. 4.

The novel invention can also be used as a step-up platform to reach portions of the walls 17 of a room by adding a third plurality of sleeves 12 and legs 14 as shown in FIG. 7. All the legs 4, 6, and 14 are adjusted so that the frame 1 is essentially parallel to the floor and the plurality of sleeves 12, 5, and 3, and the plurality of legs 14, 6, and 4, are secured by the bolts 15 and the wing nuts 13. The platform can then be moved around the wall 17 to reach different portions of the wall 17.

The preferred structure of the invention has been shown and described in detail. Various changes and modifications that are within the function of the structure as described and shown are considered to be within the spirit of the novel invention and may fall within the scope of the claims.

What I claim as my invention is:

1. A platform for stairs comprising:

a. a platform;

b. a frame integrally secured to the edges of the platform;

c. a first plurality of sleeves extending transversely from the bottom portion of the frame secured to a first edge of the platform;

d. means to attach the first plurality of sleeves to the frame of the platform near the first edge;

e. a first plurality of lower legs slid inside the first plurality of sleeves and resting on a first step or floor;

f. means to adjustably and rigidly secure the first plurality of legs to the first plurality of sleeves;

g. a second plurality of sleeves extending transversely from the middle portion of the platform and supporting the middle portion of the platform;

h. a second plurality of lower legs slid inside the first pluarlity of sleeves and resting on a second step one step higher than the first step or the floor;

i. means to attach the second plurality of sleeves to the middle portion of the platform;

j. means to secure the second plurality of legs adjustably and rigidly to the second plurality of sleeves;

k. a bottom portion of the platform and frame including the second end of the platform opposite the first end of the platform supported by resting horizontally against a third stair step two steps higher on the stairs than the first stair step or floor.

* * * * *